United States Patent [19]

Ernst

[11] 4,429,908

[45] Feb. 7, 1984

[54] LATCHING MECHANISM ON COKE OVEN DOORS

[75] Inventor: Friedrich Ernst, Dortmund, Fed. Rep. of Germany

[73] Assignee: C. Otto & Comp. G.m.b.H., Bochum, Fed. Rep. of Germany

[21] Appl. No.: 310,535

[22] Filed: Oct. 13, 1981

[30] Foreign Application Priority Data

Nov. 28, 1980 [DE] Fed. Rep. of Germany ... 8031715[U]

[51] Int. Cl.[3] ..... E05C 9/16; C10B 25/04

[52] U.S. Cl. ..... 292/35; 202/248; 292/259 R

[58] Field of Search ..... 292/1, 35, 36, 259 R, 292/259 A, 260, 33, 41; 202/239, 248; 49/465

[56] References Cited

U.S. PATENT DOCUMENTS

| | | | |
|---|---|---|---|
| 998,642 | 7/1911 | Shean | 292/36 |
| 2,338,675 | 1/1944 | Van Ackeren | 292/259 X |
| 3,043,605 | 7/1962 | McKay | 292/36 X |
| 3,510,404 | 5/1970 | Freund | 202/248 |
| 4,107,879 | 8/1978 | Steimann | 202/248 X |

FOREIGN PATENT DOCUMENTS

| | | | |
|---|---|---|---|
| 363948 | 11/1922 | Fed. Rep. of Germany | 292/35 |
| 2629354 | 6/1976 | Fed. Rep. of Germany | 202/248 |
| 496187 | 11/1938 | United Kingdom | 202/248 |

*Primary Examiner*—Thomas J. Holko
*Assistant Examiner*—R. Illich
*Attorney, Agent, or Firm*—Thomas H. Murray

[57] ABSTRACT

By providing a single biasing element (spring) connected through pull rods to toggle means in laterally-inverted relationship, there are overcome the problems of (1) inequality of forces on the latching beams and (2) the need for relatively massive springs. The toggle means provide a force-multiplying effect. Moreover, no special actuating element is required for latching or unlatching.

7 Claims, 3 Drawing Figures

LATCHING MECHANISM ON COKE OVEN DOORS

BACKGROUND OF THE INVENTION

1. Field of the Invention

This invention relates to a latching mechanism for use on coke oven doors. At least two latching beams are mounted for movement on the doors at different heights. Each such beam, when in the closed position, engages with its outer ends abuttingly onto hooks on the door frame, the door being pressed against the door frame by spring forces acting on the latching beams.

2. Description of the Prior Art

The pressure required to keep a coke-oven door closed against the door frame can, of course, be produced either by the weight of the door itself or by spring forces. In both cases, the door has disposed on it at different heights a number of latching beams (preferably two). With the latching mechanism in the closed position, the latching beams bear upon associated hooks secured to the door frame. When spring forces are used to produce the pressure, at least one compression spring is disposed on each latching beam and is operative between the door and the latching beam, the same having provision for relative movement with respect to the door. The springs can be helical compression springs or spring groups consisting of cup springs. As a rule, a spring element of this kind is disposed on a stationary pin which also carries at its free end the latching beam, which is of limited mobility. The outer termination of the pin takes the form of a nut or some similar element which is screwed onto the head of the pin, to enable the spring force to be adjusted. The element also serves as a means for engagement by external elements to latch and unlatch the door, a task for which a hydraulic actuating element disposed on the coke-side machine has recently come into use.

Spring latching systems of this kind are unsatisfactory for various reasons. Since the spring elements on the latching beams are independent of one another, there is a risk that different pressures will be set up. Moreover, the springs must be of relatively substantial dimensions in order to produce the required door-pressing pressure. Also, special actuating elements must be provided on the coke-side machine for latching and unlatching.

BRIEF DESCRIPTION OF THE DRAWINGS

A complete understanding of the invention may be obtained from the foregoing and following description thereof, taken in conjunction with the accompanying drawings, in which.

SUMMARY OF THE INVENTION

Figure 1:
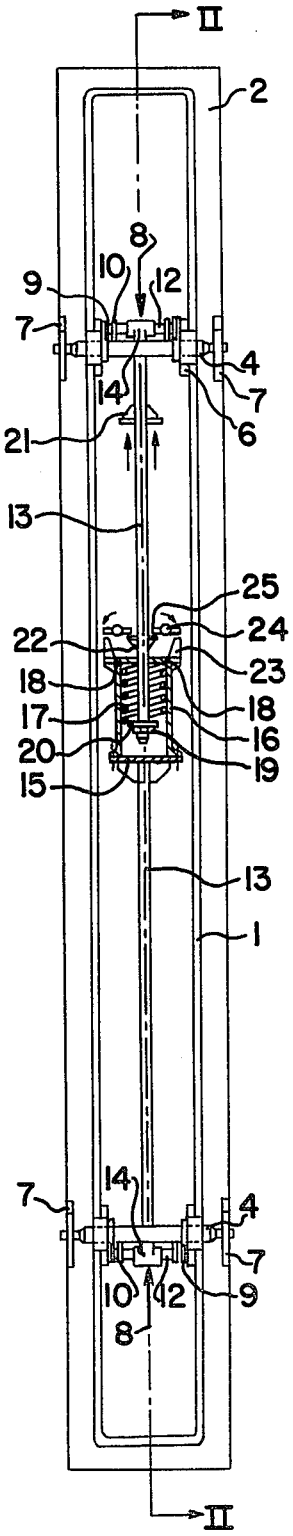
FIG. 1 is a front view of the door in closed position.
Figure 2:
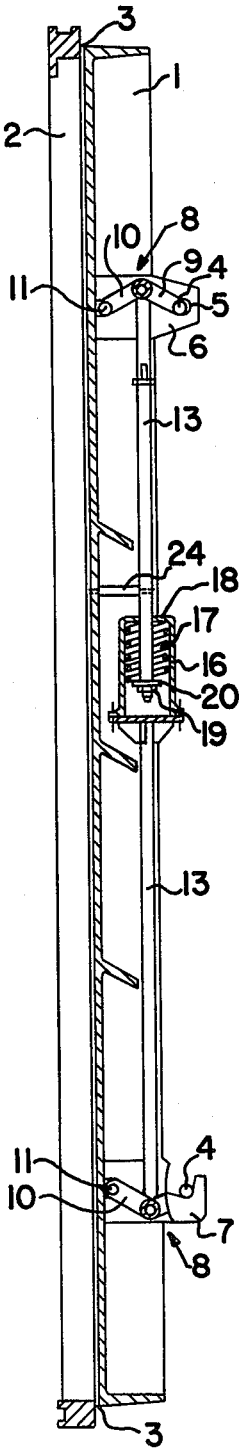
FIG. 2 is a vertical section through the central plane of the door taken on the line II—II in FIG. 1.

It is an object of the present invention to provide a spring-operated latching mechanism which is of simplified design and which is so devised that equal-pressing forces are always automatically applied to each individual latching beam of a pair of latching beams disposed on a door. No special actuating element is required for latching and unlatching.

In accordance with the invention, the latching beams are guided for movement near their free ends in slots disposed perpendicularly to the door plane in rigid retaining members which are secured to the door. Each latching beam is acted on by a toggle mechanism which produces a parallel movement in the slots. The toggle mechanisms are so disposed on two latching beams as to be in laterally-inverted relationship in respect to the angular position of their toggle arms. Two axially-consecutive, spaced-apart actuating rods are provided whose outer ends are pivoted to the central articulation of a toggle mechanism and whose inner ends are connected to a common biasing element which tends to extend the arms of the toggle mechanisms.

Advantageously, the toggle arms extend outwardly with reference to the center of the door, and the actuating rods are pull rods.

The mechanical coupling of two toggle mechanisms disposed in opposite directions has, first, the advantage that only a single spring biasing element is required for both the toggle mechanisms, and the forces transferred to the latching beams are always the same. The spring-biasing element can be smaller than previously, since the reaction force of the spring is used. Moreover, the multiplication of force which a toggle mechanism can provide means that smaller springs can be used to obtain a given latching force.

There is a design advantage in having the pull rods each rotatably connected at their outer ends to the pivot pin of the corresponding toggle mechanism by way of a connecting member which has a continuous transverse passage.

In another development of the latching in accordance with the invention, the ends of the arms of a U-shaped retaining member are secured to the inner end of one of the two pull rods. A compression spring, e.g., a helical compression spring or a spring group, is used inside the U-member. The other pull rod has its inner end extending through the U-member and the spring and has an external screw-threaded portion receiving a nut for adjusting the biasing of the spring.

Another feature relates to the operation of the latching mechanism for unlatching. In accordance with this feature, two oppositely-directed rigid projections are secured at a distance from the U-member to the pull rod which can move relatively thereto. Two axially-extending rigid webs associated with the latter projections are disposed on the U-member. The free ends of the webs are disposed substantially at the same height as the abutment surfaces of the projections. The door has secured to it, substantially centrally of the gap between a projection and the associated web, a pin or peg or the like which is perpendicular to the plane of the door and on which pin or peg a double-armed lever bridging the gap between the projection and the web and disposed adjacent to their abutment surfaces is mounted for pivoting.

The use of the system hereinabove described has the advantage that the door is unlatched simultaneously with the engagement of the lifting claws of the coke-side machine. Consequently, in contrast to conventional spring-latching facilities, it is unnecessary to provide a special actuating element on the coke-side machine.

The use of a latching mechanism in accordance with the invention on a two-beam door for horizontal coke ovens is illustrated in the drawings.

A movable door 1 is a unitary casting substantially in the form of a rectangular box open on one side. In the closed position, the outer edge of the door is engaged at a predetermined pressure with a stationary door frame 2, with the intercalation between the frame 2 and the corresponding outer edge of the door 1 of a resilient edge-like sealing element 3 to provide satisfactory sealing tightness.

Two latching beams 4 for latching the door 1 are so disposed thereon as to extend transversely of the door's longitudinal axis. Each of the beams 4 is guided in the vicinity of its free ends for movement in slots 5 which extend perpendicularly to the plane of the door in rigid retaining members 6 which are secured to the door 1. Two hooks 7 open at the top are rigidily secured to the door frame 2 at the height of the beams 4. When the door 1 is in a closed position, the hooks 7 engage around the free ends of the beams 4, serving to retain the door 1 and, with their hook ends, acting as an abutment for the movable beams 4.

A toggle mechanism 8 consisting of two spaced-apart pairs of arms is disposed on each beam 4. The arms 9, 10 of a pair of such arms have their free ends pivotally connected to a bearing pin 11 on the door 1 and to the beam 4. The central pivots of the two pairs of arms are interconnected by a common pivot pin 12. As the drawings show, the toggle mechanisms 8 of the top and bottom beams 4 are in laterally-inverted relationship to each other, so far as the angular position of their arms 9, 10 is concerned.

Joint actuation of the mechanisms 8 is provided by means of two pull rods 13, which extend toward the respective centers of the mechanisms 8 and which are rotatably connected at their outer ends by way of a connecting member 14, the member 14 having a transverse continuous passage, to the pivot pin 12 of the corresponding toggle mechanism 8. At their inner ends, the pull rods 13 are biased by a spring element devised as follows.

A rigid transverse member 15 on which a U-shaped retaining member 16 can be releasably secured is disposed on one of the pull rods 13. Preferably, continuous or threaded screws are used to secure the member 16 at its arm ends. Member 16 serves to receive a helical compression spring 17 through which the outer end of the other pull rod 8 extends, and which is guided for lengthwise movement of a bore 18 in the cross web of the member 16. The outer portion of pull rod 8 has external screw-threading which receives an adjusting nut 19, which serves as a variable abutment for a disc 20. Spring 17 is engaged between disc 20 and the cross web of member 16.

The spring 17 biases the pull rods 13 toward each other, that is, so that the toggle mechanisms 8 are biased by the force of a single compression spring in the sense of an extension of their arms 9, 10. Such movement of the arms 9, 10 produces a parallel movement of the latching beams 4 in a direction away from the door frame 2. However, when the beams 4 engage the hooks 7, the load acting on the mechanisms 8 produces pressure on the door 1, so that the door 1 is pressed against the door frame 2.

Figure 3:
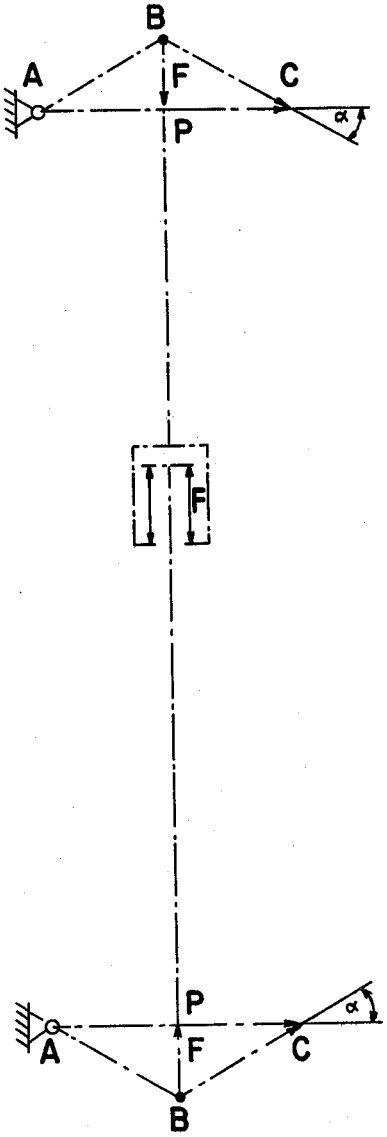
FIG. 3 is a diagram of forces obtained with the toggle mechanisms.

The diagram of forces of FIG. 3 clearly shows the main advantages which reside in the use of two toggle mechanisms actuated by a single spring. One advantage is that both the latching beams always experience identical latching forces P. Another advantage is that the effective latching force P is amplified, as compared with the spring force F, by a substantial factor. In practice, this factor is something like 1.7 to 3.7 times as much force, in accordance with the angle $\alpha$ chosen. This can be seen from the following numerical examples:

$\alpha=30°$; $P=1.732\times F$;
$\alpha=20°$; $P=2.7475\times F$;
$\alpha=15°$; $P=3.732\times F$.

The features now to be described insure that the door is unlatched simultaneously as the claws of the coke-side machine engage. Two projections 21 are provided on opposite sides of the top pull rod 13 for engagement of the claws. Other projections 22 having upwardly-extending abutment surfaces are provided near the member 16. The member 16 has two web-like projections 23, the end faces of which are at substantially the same height as the abutment surfaces of the projections 22. Two pins or pegs 24 or the like disposed perpendicularly to the plane of the door 1 are secured to the door 1 in a position such that each pin 24 is disposed substantially centrally of the gap between a projection 22 and the associated web 23. A two-armed lever 25 is pivotally mounted on each pin 24. With the door in the closed position, the arms of lever 25 extend substantially perpendicularly to the longitudinal axis of the door 1. When the pull rod 13 is moved in the direction of the arrow by means of the claws engaged with the projections 21, the projections 22 cause the levers 25 to rotate. Therefore, the member 16 is caused to be pressed back in the opposite direction. Consequently, the two toggle mechanisms 8 are actuated in the direction of an unlatching when the door-opening mechanism comes into operation.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. A mechanism for latching to a coke-oven door frame a coke-oven door, said mechanism comprising:

first and second latching beams mounted on said door for movement toward and away from said door, said latching beams being at different heights with respect to said door, hooks so mounted upon said door frame as to be in abutting relationship with outer ends of said first and second latching beams when said latching mechanism is in a closed position, means secured to said door for guiding each of said latching beams for movement in a plane perpendicular to that of said door, first and second toggle mechanisms operatively associated with, respectively, said first and second latching beams, each of said toggle mechanisms comprising a pivot and a pair of toggle arms having portions distal with respect to said pivot which are in operative association with said latching beams, a common biasing element, and actuating rods connecting said common biasing element and said pivots of said toggle mechanisms.

2. A mechanism according to claim 1 wherein said means secured to said door for guiding each of said latching beams comprises rigid retaining members secured to said door and having therein slots disposed perpendicular to the plane of said door.

3. A mechanism according to claim 1 characterized in that said toggle arms extend outwardly with reference to the center of said door and said actuating rods are pull rods.

4. A mechanism according to claim 1 characterized in that each toggle mechanism comprises two pairs of arms which extend in the same direction and are pivotally connected in spaced-apart relationship at one end to one of said latching beams and at an opposite end to a fixed attachment zone on said door, the central joints of said toggle mechanisms being interconnected by a common pivot pin.

5. A mechanism according to claim 4 characterized in that said pull rods are each rotatably connected at their outer ends to said pivot pin of a corresponding toggle mechanism by way of a connecting member which has a continuous transverse passage.

6. A mechanism according to claim 5 characterized in that the ends of the arms of a U-shaped retaining member are secured by way of a rigid cross member to the inner end of a pull rod, a compression spring being disposed inside said U-member, and the other one of said pull rods having its inner end extending through said U-member and spring and having an externally screw-threaded portion receiving a nut for adjusting the biasing of said spring.

7. A mechanism according to claim 6 characterized in that two oppositely-directed rigid projections are secured at a distance from said U-member to said pull rod which can move relatively thereto, two axially-extending rigid webs associated with said rigid projections being disposed on said U-member, the free ends of said webs being disposed substantially at the same height as the abutment surfaces of said projections, and said door having secured to it substantially centrally of the gap between one of said projections and its associated web a pin or peg which is perpendicular to the plane of said door and on which a double-armed lever bridging the gap between said projection and said web and disposed adjacent to their abutment surfaces is mounted for pivoting.

* * * * *